US005779066A

United States Patent [19]

Drower et al.

[11] Patent Number: 5,779,066

[45] Date of Patent: Jul. 14, 1998

[54] STORAGE RACK WITH RETAINER LOOPS MAINTAINING UNIFORM PRESSURE AGAINST THE ARTICLES BEING HELD

[75] Inventors: Herbert M. Drower, Wilmette, Ill.; Dean S. Paris, Takoma Park, Md.

[73] Assignee: Transilwrap Company, Inc., Chicago, Ill.

[21] Appl. No.: 719,154

[22] Filed: Sep. 24, 1996

[51] Int. Cl.[6] ..... A47F 5/00

[52] U.S. Cl. ..... 211/89.01; 211/60.1; 211/69.8; 211/120

[58] Field of Search ..... 211/60.1, 69.8, 211/89.01, 70.6, 120

[56] References Cited

U.S. PATENT DOCUMENTS

| | | | |
|---|---|---|---|
| 1,746,577 | 2/1930 | Berglund et al. | 211/120 X |
| 2,430,624 | 11/1947 | Vollmer | 211/120 |
| 4,936,469 | 6/1990 | Drower . | |
| 5,398,823 | 3/1995 | Anders | 211/70.6 |
| 5,419,443 | 5/1995 | Niederberger et al. | 211/70.6 |
| 5,570,794 | 11/1996 | Drower | 211/69.8 X |

FOREIGN PATENT DOCUMENTS

| | | | |
|---|---|---|---|
| 8483 | 4/1904 | Austria | 211/69.8 |

*Primary Examiner*—Jose V. Chen

*Attorney, Agent, or Firm*—Dorn, McEachran, Jambor & Keating

[57] ABSTRACT

A rack for supporting small articles or aligning wires. The rack may either be hung on a vertical surface or seated on a horizontal surface. The rack includes an elongated housing with an elongated entrance slot formed in its front wall. A multiplicity of retainer loops are supported side-by-side on the elongated housing with their bight portions in front of the housing to receive and support the small articles and to align the wires. The retainer loops are formed with tails which hold them in the elongated housing and have slots which fit over a rib in the housing to prevent twisting of the loops. The end of the rib may be enlarged to be received in complementary shaped slots in the loops to increase pull out resistance of the retainer loops. When small articles or wires are inserted between pairs of retainer loops, the tails of the loops will slide along the rib to accommodate articles of varying cross sections while maintaining essentially uniform pressure against the articles being held. The rack is formed so that it may be supported by fasteners, suction cups or adhesive, including stick wax blocks of adhesive.

6 Claims, 3 Drawing Sheets

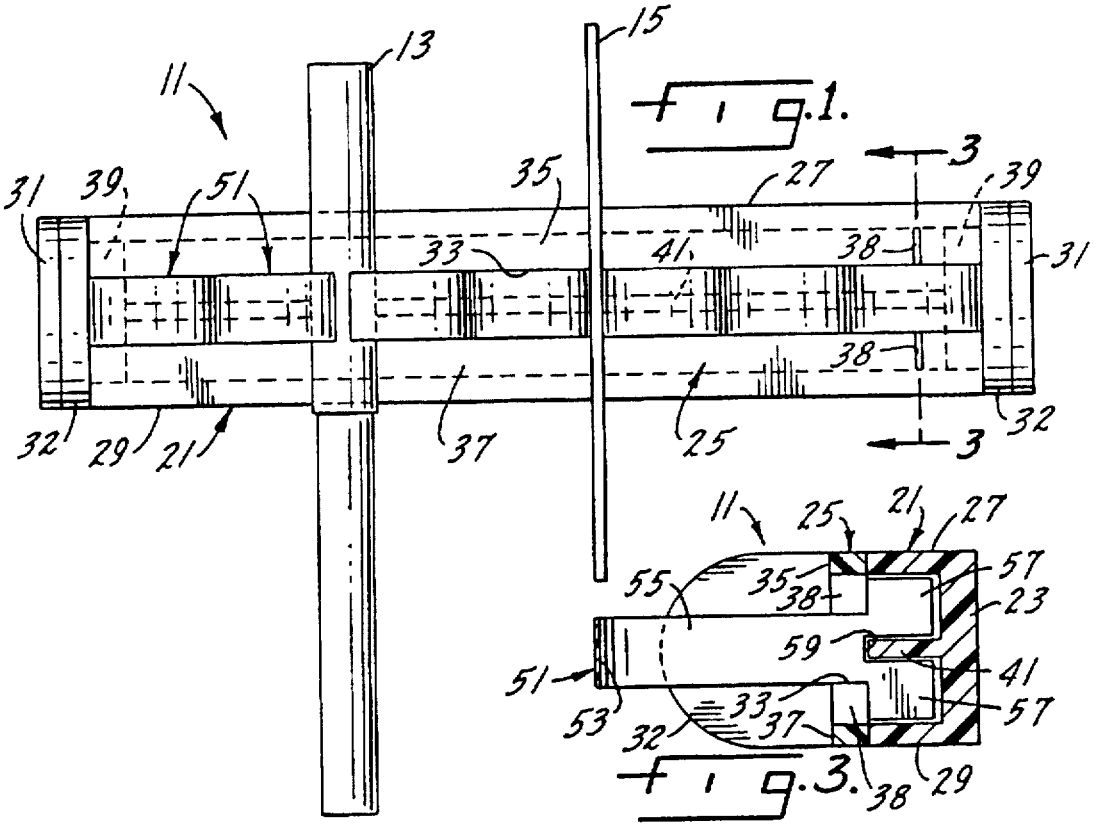
Fig. 1.
Fig. 3.
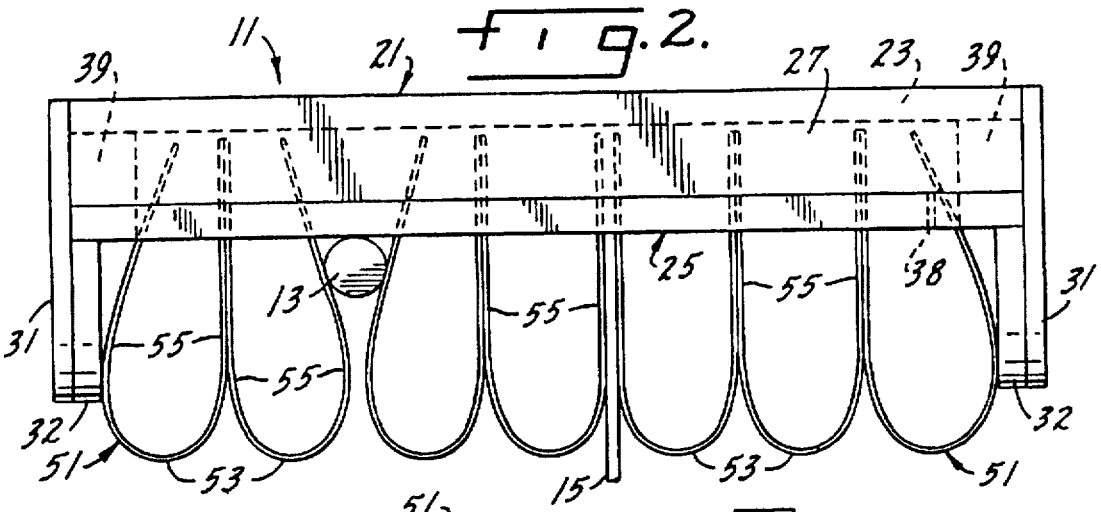
Fig. 2.
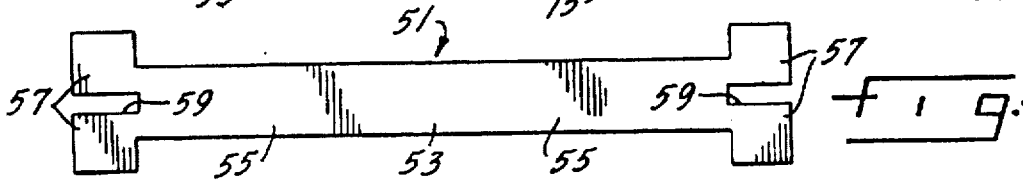
Fig. 4.

135
131
161
181
183
159
165
163
137
203
201
101
105
13
15
103
107
109
113
111

135
187
143
161
131
133
181
151
141
183
189
153
191
157
155
185
187
137
145
203
101
105
113
103
123
107
109
111
121
119

105
103
115
115
111
113
107
109
117
117

187
183
187
189
191
191
189
187
185
181
185
187

STORAGE RACK WITH RETAINER LOOPS MAINTAINING UNIFORM PRESSURE AGAINST THE ARTICLES BEING HELD

BACKGROUND OF THE INVENTION

Storage racks for small articles, ranging from pencils and pens to other items such as paint brushes, cassettes, computer floppy discs and small containers are available in many sizes, styles, constructions and configurations. Previously known storage racks do not effectively maintain a uniform holding pressure against articles inserted between a pair of loops, especially when the supported articles vary in thickness or weight or if a large number of articles are supported on the rack at one time. Previously used plastic loops lost their gripping strength due to the type of flow usually referred to as "creep" and were subject to unintentional removal due to twisting.

SUMMARY OF THE INVENTION

It is a principal object of the present invention, therefore, to provide a new and improved storage rack for small articles and things utilizing plastic loops which provide a uniform holding pressure against an article or thing being supported regardless of its weight or thickness and independently of the number of articles being held in the storage rack.

Another object of this invention is a storage rack having supporting loops which maintain a sufficiently constant pressure on the articles and things being held that the rack may be used as a wire guide.

An additional object of this invention is a storage rack which provides for the easy installation of supporting loops but resists the unintentional pull out of these loops.

Yet another object of this invention are article-supporting loops which are mounted in a manner which permits their legs to slide along the length of the storage rack but resist pullout of the loops during such sliding movement.

Still another object of this invention are article-supporting loops formed of strips of tough, resilient, abrasion-resistant resin having legs which are free to slide along the length of the rack to accommodate supported articles and things of varying weights and cross sections while maintaining a substantially uniform holding pressure against the articles and things being supported.

Yet an additional object of this invention is a retaining loop for a storage rack that is highly resistant to the type of flow usually referred to as "creep".

Still an additional object of this invention is a storage rack that is formed so that it may be supported by fasteners, suction cups or adhesive, including but not limited to stick wax blocks of adhesive.

Accordingly, the invention relates to a storage rack for small articles and things comprising an elongated housing having a rear wall adapted to be positioned against a supporting surface, a front wall including upper and lower portions separated by a narrow opening extending substantially the entire length of the housing and a rib extending forwardly of the rear wall in alignment with the narrow opening. A multiplicity of retainer loops are mounted side by side on the elongated housing. Each retainer loop is formed of a strip of a tough, resilient, abrasion-resistant resin. Each retainer loop has a bight portion, two legs, a tail formed at the end of each leg and a notch formed in each tail. The retaining loops are installed in the elongated housing with their legs extending through the narrow opening in the front wall of the housing and with the bight portions of the loops positioned outwardly of the front wall. The tails of the legs of the loops engage the upper and lower portions of the front wall and the notches of the legs of the loops receive the rib. The legs of adjacent loops will slide along the length of the rib when elongated articles are inserted between pairs of retaining loops to thereby accommodate articles or things of varying cross sections while maintaining essentially uniform pressure against the articles or things being held in the storage rack.

BRIEF DESCRIPTION OF THE DRAWINGS

The invention is illustrated more or less diagrammatically in the following drawings wherein:

FIG. 1 is a front elevational view of a first embodiment of a storage rack for small articles constructed in accordance with the teachings of the present invention;

FIG. 2 is a top plan view of the storage rack of FIG. 1;

FIG. 3 is a cross sectional view taken along line 3—3 of FIG. 1;

FIG. 4 is a plan view of a first embodiment of a loop in its flattened outstretched condition;

DESCRIPTION OF THE PREFERRED EMBODIMENTS

Figure 5:
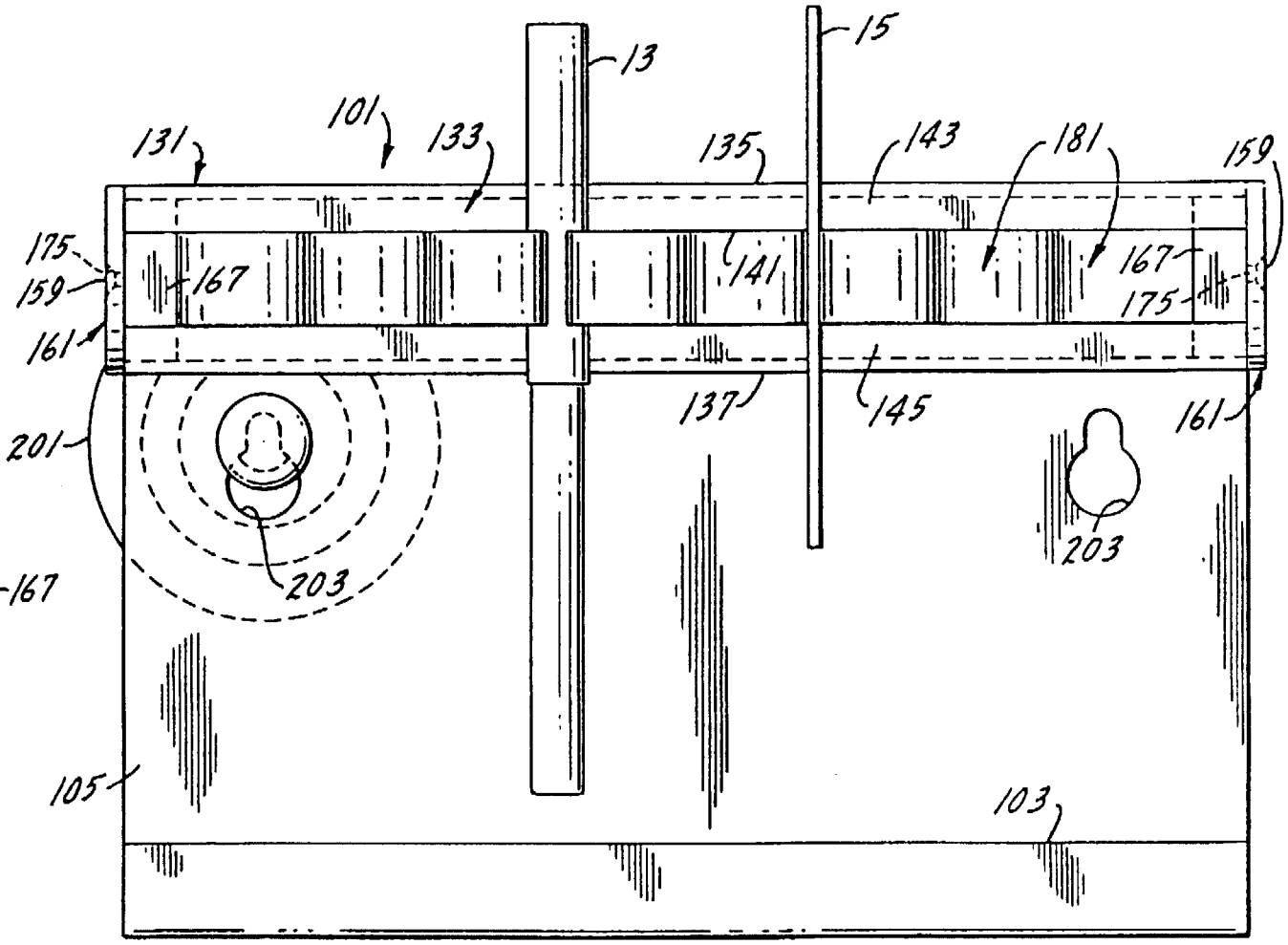
FIG. 5 is a front elevational view of a second embodiment of a storage rack for small articles constructed in accordance with the teachings of the present invention with some hidden parts shown in dashed lines.

FIGS. 1 to 4 of the drawings illustrate a first embodiment of the invention shown as an elongated rack 11 which is intended to be used for the storage of a variety of small articles of varying sizes, shapes and weights. Specifically, for purposes of illustration, and not by way of limitation, a pen 13 and a computer floppy disc 15 are shown supported on the rack. It should be understood and appreciated that other articles such as measuring tapes, chalk, putty knives, erasers, paint brushes, cassettes, etc., may be stored on such a rack and the rack, either alone, or in association with other similar racks may be used as a wire guide.

The storage rack 11 includes an elongated housing 21 which may be formed of plastic or wood or other suitable material and includes a rear wall 23 which may be provided with openings for receiving screws or other fasteners to attach the rear wall to a supporting wall with neither the openings or the supporting wall shown in the drawings for clarity of illustration. Completing the housing are a front wall 25, a top wall 27, a bottom wall 29 and end walls 31. The end walls 31 extend forwardly of the front wall. 25 of the elongated housing 21 and the portions of the end walls located forwardly of the front wall are enlarged laterally with lugs 32. A narrow opening or passage 33 is formed in the front wall 25 and divides the front wall into upper and lower portions 35 and 37, respectively. A retainer loop insertion slot 38 extends through the upper and lower portions 35 and 37 of the front wall 25. Abutments 39 are formed in the housing adjacent the end walls 31. A rib 41, which may be formed integrally with the rear wall 23, extends forwardly of the rear wall terminating adjacent the inner surface of the front wall 25.

The storage rack 11 further includes a multiplicity of retainer loops 51. The retainer loops are each formed of a strip of a tough, resilient, abrasion-resistant resin, preferably a polyester resin or a laminate. The preferred resin for the retainer loops is two layers of oriented polyethylene terephthalate laminated with a central layer of polyethylene, the same basic construction as is used in commercial identification cards and similar articles. The strip of resin should be formed having a width equal to the width of the narrow opening 33 in the front wall 25 of the housing 21.

Each retainer loop 51 is formed with a bight portion 53 joining a pair of legs 55. A laterally extending tail 57 is formed at the distal end of each leg. A longitudinally notch 59 is formed in the tail at the end of each leg.

Each retainer loop 51 is supported on the storage rack 21 by inserting the tails 57 of its legs 55 into the loop insertion slot 38 so that the notches 59 receive and fit over the rib 41. When the legs of the retainer loops are so installed, the tails 57 of the legs 55 engage the rear surfaces of the upper and lower portions 35 and 37 of the front wall 25 of the elongated housing 21. Also, the bight portions 53 of the retainer loops will extend outwardly of the front wall 25 of the housing and will be supported by both the lower portion 37 of the front wall and the rib 41.

The number of retainer loops 51 inserted into the narrow opening 33 will depend on the average size of the articles expected to be supported on the rack. Because the tails 57 of each of the legs of the loops are free to slide along the rib 41, it is possible to accommodate articles placed between a pair of loops, even though the articles vary considerably in their cross sections, while maintaining the pressure by the legs of the loops against the object or article being supported at a generally uniform level. The provision of the tails 57 of the legs 55 of the loops 51 to engage the inner surfaces of the upper and lower portions 35 and 37 of the front wall 25 in combination with the engagement of the rib 41 with the portions of the tails around the notches 59 prevents a pull-out of the loops 51 even under relatively heavy loads provided by the articles being held. The end walls 31 of the housing also function to hold the retainer loops in position and maintain a uniform pressure against the articles being held. The lug portions 32 of the end walls which extend outwardly of the front wall 35 engage the end retainer loops near the bight portions thereof while the abutments 39 engage the loops near their tails 57.

Although the storage rack 11 of the first embodiment of the invention is shown with a single elongated housing 21, it should be understood and appreciated that the housing 21 may be made in sections attached to one another to create a storage rack of a desired capacity. Further, it is within the teachings of this invention to make an elongated housing with several discrete openings or passages 33 located end to end for receiving groups of retainer loops 51 rather than one extremely long opening 33 since a more uniform pressure is obtained against the objects being held by limiting the number of retainer loops in each grouping.

Figure 6:
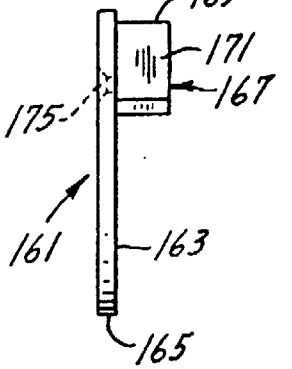
FIG. 6 is a top view of an end wall of the storage rack of FIG. 5.
Figure 7:
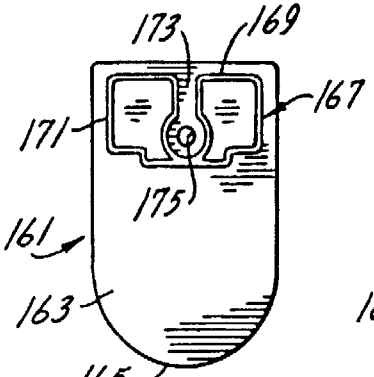
FIG. 7 is a side elevational view of the end wall of FIG. 6.
Figures 8, 9, 10, 11:
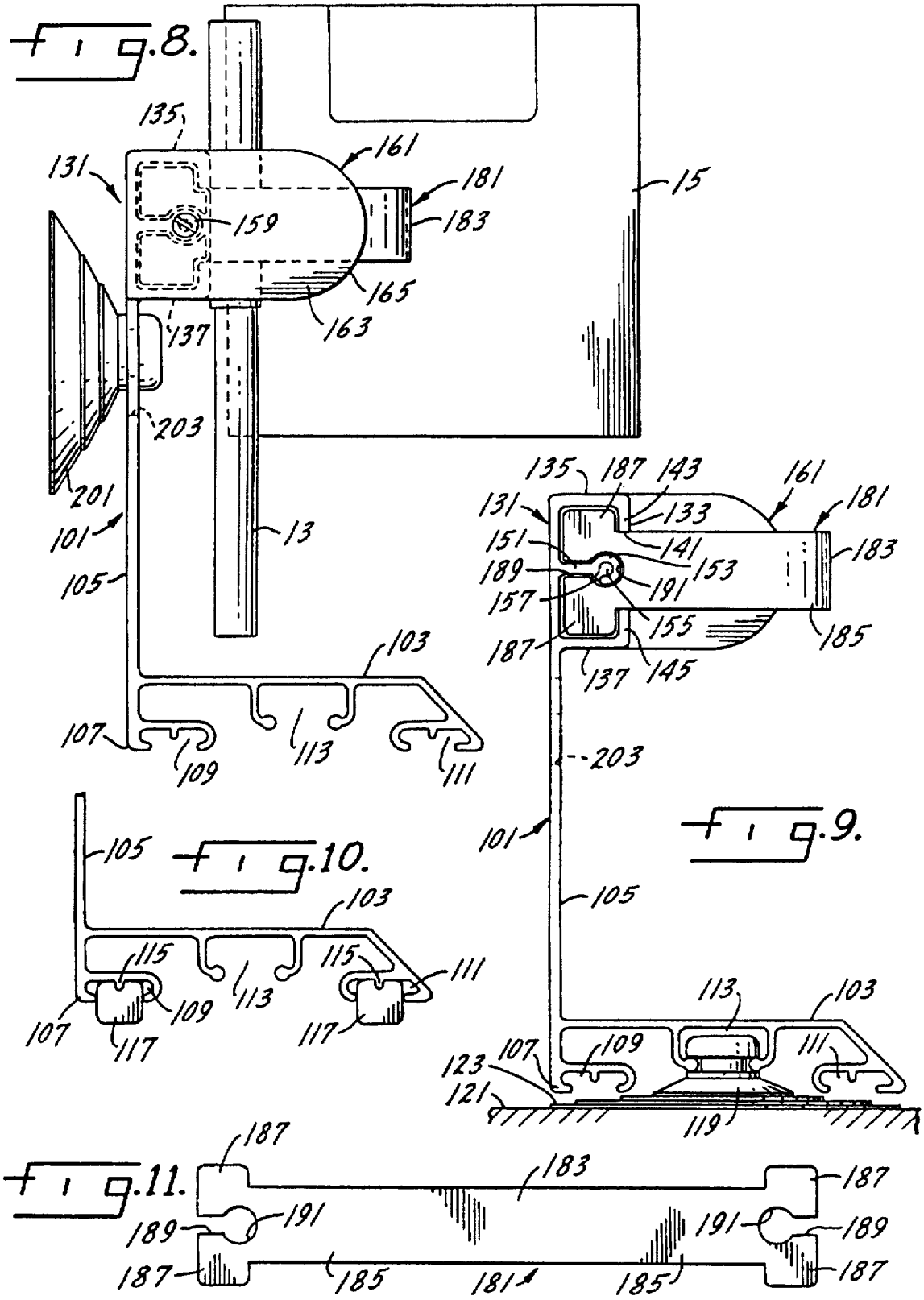
FIG. 8 is a side elevational view of the storage rack of FIG. 5 with some hidden parts shown in dashed lines.
FIG. 9 is a side elevational view of the storage rack of FIG. 5 with some parts removed and shown supported on a horizontal surface.
FIG. 10 is a partial side elevational view of a modified form of a mounting base.
FIG. 11 is a plan view of a loop of the modified storage rack shown in its flattened, outstretched condition.

A second embodiment of the invention is shown in FIGS. 5–11 of the drawings. The storage rack 101 shown in these drawings is suitable for attachment to either a vertical or a horizontal supporting surface. The storage rack 101 is preferably injection molded of a suitable plastic and includes a base 103 and an upright wall portion 105 formed integrally. The base 163 is offset from the bottom edge 107 of the upright wall portion 105 and can be seen most clearly in FIGS. 8, 9 and 10 of the drawings. Downwardly opening channels 109, 111 and 113 are formed below the base 103 and these channels extend across the width of the storage rack. Ribs 115 are provided in channels 109 and 111 to dig into blocks of adhesive wax 117 which are inserted into the channels in the manner shown in FIG. 10 of the drawings to adhere the storage rack to a horizontal supporting surface which is not shown in FIG. 10 of the drawings. The center and wider channel 113 receives and supports suction cups 119 to adhere the storage rack to the horizontal supporting surface 121 as shown in FIG. 9 of the drawings.

To permit the mounting of the storage rack 101 on uneven or slightly rough surfaces such as the horizontal surface 121, a thin sheet 123 of a plastic having a layer of a pressure sensitive adhesive on the side facing the supporting surface, which adhesive is not shown in the drawings, is provided. This mounting arrangement works especially well when the suction cups 119 engage the adhered plastic sheet 123 attached to the surface 121 as shown in FIG. 9 of the drawings.

An elongated housing 131 is formed integrally with the upright wall portion 105 of the storage rack 101 at the upper end of the upright wall portion. The upright wall portion 105 forms the rear wall of the housing. Completing the housing 131 are a front wall 133, a top wall 135 and a bottom wall 137 all formed integrally with the upright wall portion 105 of the storage rack 101. A narrow opening or passage 141 is formed in the front wall 133 and this opening divides the front wall into upper and lower portions 143 and 145, respectively.

A rib 151 shown in FIG. 9, which may be formed integrally with the upright wall portion 105, extends forwardly of the rear wall of the housing 131 terminating in an enlarged semi-cylindrical nose 153 positioned adjacent the inner surface of the front wall 133 of the housing 131. The nose 153 is molded with a hole 155 at each end and an elongated slot 157 extending into each hole to allow expansion of the nose to receive screws 159 to fasten the end walls 161 to the elongated housing 131 as shown in FIG. 8 of the drawings.

The end walls 161 as shown in FIGS. 6 and 7 are each molded in one integral piece having a planer portion 163 of somewhat rectangular shape with an arcuate end 165 and an irregularly shaped wall 167 projecting from the planer portion 163. The irregular wall includes ribs 169 defining a somewhat rectangular plug 171 which snugly fits into the open ends of the housing 131. The ribs 169 also define a recess 173 which receives the rib 151 and nose 153 of the wall portion 105. A passage 175 is formed through the planer portion 163 of the end wall 161 to receive the screw 159 to fasten the end wall to the housing as shown in FIGS. 5 and 8 of the drawings.

The storage rack 101 further includes a multiplicity of retainer loops 181. The retainer loops are each formed of a strip of a tough, resilient, abrasion-resistant resin, preferably a polyester resin or a laminate. The preferred resin for the retainer loops is two layers of oriented polyethylene terephthalate laminated with a central layer of polyethylene, the same basic construction as is used in commercial identification cards and similar articles. The strip of resin should be formed having a width equal to the width of the narrow opening 141 in the front wall 133 of the elongated housing 131.

Each retainer loop 181 as shown most clearly in FIG. 11 is formed with a bight portion 183 joined by a pair of legs 185. A laterally extending tail 187 is formed at the distal end of each leg. A longitudinally extending notch 189 is formed in the tail at the end of each leg and at its inner end the notch expands to a circular configuration 191.

Each retainer loop 181 is installed on the storage rack 101 by removing an end wall 161 and inserting the tails 187 of the legs 185 of the loop into the housing 131 so that the circular opening 191 of the notch 189 of each tail fits over the semi-cylindrical nose 153 of the rib 151 as can be viewed in FIG. 9 of the drawings. When the retainer loops are so installed, the tails 187 of the legs 185 engage the rear surfaces of the upper and lower portions 143 and 145 of the front wall 133 of the elongated housing 131. Also, the bight portions 183 of the retainer loops 181 will extending outwardly of the front wall 133 of the housing through the passage 141 and the retainer loops 181 will be supported by both the lower portion 145 of the housing and the rib 151 and its nose 153.

The number of retainer loops 181 inserted into the narrow passage 141 of the storage rack 101 will depend on the average size of the articles expected to be supported in the rack. Because the tails 187 of each of the legs of the loops are free to slide along the nose 153 and the rib 151, it is possible to accommodate articles placed between a pair of ribs even though the articles may vary considerably in their cross sections while maintaining the pressure exerted by the legs of the loop against the object or article at a generally uniform level. The provision of the tails 187 of the legs 185 of the loops 181 to engage the inner surfaces of the upper and lower portions 143 and 145 of the front wall 133 in combination with the engagement of the rib nose 153 with the portions of the tail around the notches and circular cut out portion 191 prevents a pull out of the loops 181 even under relatively heavy loads provided by the articles being held.

The end walls 161 of the housing 101 also function to hold the retainer loops 181 in position on the storage rack 101 and maintain a uniform pressure against the articles being held in the rack. The planer portions 163 of the end walls engage the retainer loops at opposite ends of the rack near the bight portions 183 thereof. The plug portions 171 of the end walls engage the retainer loops near their tails 187.

The storage rack 101 may also be supported on a vertical surface, which is not shown, in the manner depicted in FIG. 8 of the drawings in which suction cups 201 are anchored in keyhole openings 203 in the upright wall portion 105 of the rack. Additionally, it is apparent that instead of suction cups, screws 159 may be installed through the keyholes 203 to support the rack on a vertical surface or under appropriate circumstances, adhesives, including but not limited to stick wax blocks or double sided adhesive tape may be used.

We claim:

1. An elongated rack for supporting or aligning small articles or elongated things, said rack including:

an elongated housing having a rear wall adapted to be positioned against a supporting surface, a front wall including upper and lower portions separated by a narrow, elongated opening extending substantially the entire length of said housing, a rib extending forwardly of said rear wall in alignment with said narrow, elongated opening, and a multiplicity of retainer loops mounted side by side on said elongated housing, each retainer loop formed of a strip of a tough, resilient, abrasion-resistant resin and having a bight portion and two legs with a tail formed at the end of each leg and a notch formed in each tail, said retainer loops mounted in said elongated housing with said legs extending through said narrow, elongated opening in said front wall of said elongated housing with said bight portions of said loops positioned outwardly of said front wall, said tails of said loops engaging said upper and lower portions of said front wall and said notches of said retainer loops receiving said rib.

2. The elongated rack of claim 1 in which said rib has a cylindrical portion at its retainer loop notch receiving end and said notches have complementary shaped cut-outs to receive said cylindrical portion of said rib.

3. The elongated racy of claim 1 in which an insertion slot is formed in said front wall of said elongated housing to receive the tails of said retainer loop legs.

4. An elongated rack for supporting or aligning small articles or elongated things, said rack including:

an elongated housing having a front wall including upper and lower portions separated by a narrow, elongated opening extending substantially the entire length of said housing, a rib mounted in said housing in alignment with said narrow opening and having a cylindrical nose positioned adjacent said narrow, elongated opening, a multiplicity of retainer loops mounted side by side on said elongated housing, each retainer loop formed of a strip of a tough, resilient, abrasion-resistant resin and having a bight portion and two legs with a tail formed at the end of each leg and a notch formed in each tail, and a notch formed in each tail with each notch having a cylindrical cut-out portion located at its inner end, said retainer loops mounted in said elongated housing with said legs extending through said narrow, elongated opening in said front wall of said elongated housing with said bight portions of said loops positioned outwardly of said front wall, said tails of said loops engaging said upper and lower portions of said front wall and said notches of said retainer loops receiving said rib, said tails of said loops engaging said upper and lower portions of said front wall and said notches and cylindrical cut-outs of said retainer loops receiving said rib and said cylindrical nose, and an opening in said elongated housing to permit insertion of said tails of said retainer loops over said rib and its cylindrical nose.

5. The elongated rack of claim 4 in which said retainer loop tail inserting opening is located in said housing at an end of said rib.

6. The elongated rack of claim 4 in which said elongated housing is formed with open ends, said open ends being formed and adapted to receive said tails of said retainer loops for slidable mounting on said rib and its cylindrical nose with said legs in said narrow, elongated opening of said front wall, end walls are provided to close said open ends to hold said retainer loops in said housing;

said end walls each having an integrally formed plug which extends into said housing when said end walls close said open ends of said housing to abut said tails of said retainer loops.

* * * * *